United States Patent [19]

Becker et al.

[11] 4,036,156

[45] July 19, 1977

[54] DEVICE FOR SEWING TOGETHER PLIES OF MATERIAL ADJUSTED TO EQUAL LENGTHS

[75] Inventors: Dietmar Becker, Kaiserslautern; Fritz Jehle, Enkenbach-Alsenb.; Rubi Schönthaler, Kaiserslautern; Erich Willenbacher, Karlsruhe, all of Germany

[73] Assignee: Pfaff Industriemaschinen GmbH, Germany

[21] Appl. No.: 636,995

[22] Filed: Dec. 2, 1975

[30] Foreign Application Priority Data

Dec. 12, 1974 Germany ..... 2457535
Oct. 11, 1975 Germany ..... 2545685

[51] Int. Cl.[2] ..... D05B 21/00

[52] U.S. Cl. ..... 112/121.26; 112/203; 112/207

[58] Field of Search ..... 112/121.26, 121.27, 112/121.15, 203, 207, 65

[56] References Cited

U.S. PATENT DOCUMENTS

| | | | |
|---|---|---|---|
| 3,267,892 | 8/1966 | Maschmann et al. | 112/65 X |
| 3,349,732 | 10/1967 | Perrella et al. | 112/65 |
| 3,550,544 | 12/1970 | Perla | 112/121.26 |
| 3,713,408 | 1/1973 | Deeks et al. | 112/121.26 X |
| 3,903,818 | 9/1975 | Marforio | 112/121.26 X |

*Primary Examiner*—H. Hampton Hunter
*Attorney, Agent, or Firm*—McGlew and Tuttle

[57] ABSTRACT

The device is for use in a sewing unit including a sewing machine and includes a vertically oriented relatively elongated intermediate plate separating two plies of material in advance of the sewing machine. Guide elements adjacent the intermediate plate support a clasping station for movement longitudinally of the intermediate plate. The clasping station includes a support mounting two clasps each selectively engageable with a respective ply of material. Photoelectric sensing devices are movable with the clasping station, and include respective sensing devices operatively associated with each ply of material and each operable to control engagement of a respective clasp with the associated ply of material responsive to sensing of the trailing edge of the associated ply of material. A counterweight arrangement exerts an adjustable pull on the clasping station in a direction opposite to the feed direction of the plies of material. In one embodiment, a lifting carriage supports the sensing devices and effects lifting of the clasping station. In a second embodiment, the sensing devices are mounted on the same support which mounts the clasps.

10 Claims, 8 Drawing Figures

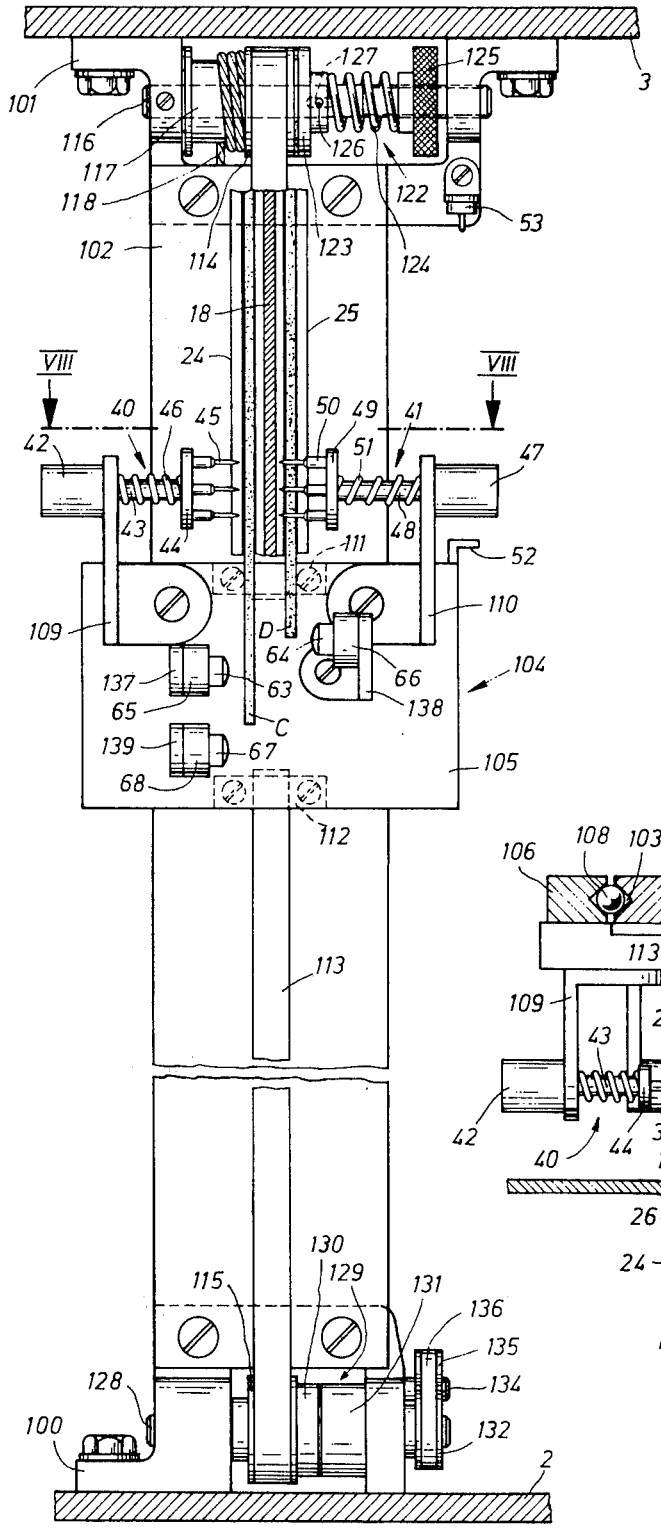
Fig.7
Fig.8
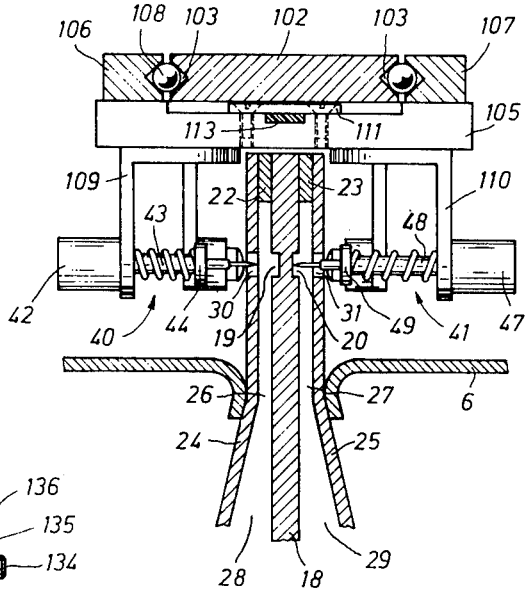

DEVICE FOR SEWING TOGETHER PLIES OF MATERIAL ADJUSTED TO EQUAL LENGTHS

FIELD AND BACKGROUND OF THE INVENTION

The present invention relates to a device to be mounted in sewing units and intended for adjusting plies of material, which are to be sewn together by means of a sewing machine and which register with each other at their leading edges, to mutually equal lengths and/or for holding them in such adjusted equal length position.

While sewing together plies of material, for example, cut pieces such as used in the manufacture of trousers, to obtain a faultless working result, it is necessary to sew the plies together so as to bring not only their outlines but also their lengths into registration. Differences in length may occur so that, in spite of an exactly uniform operation of the feed tools, the plies of material are fed at unequal advance velocities due to unequal friction conditions, with the result of a mutual displacement of the plies during the sewing operation. However, it may happen that already the initial lengths of the plies are different, because of an inaccurate cutting.

In a known sewing unit, prior to the sewing operation, the leading edges of the plies of material are clamped in registry with each other between the feed tools of the sewing machine, and the trailing edges are clamped, also in registry with each other, into a horizontally movable, weight loaded, trailing clamp. Due to the stretching of the two plies caused by the trailing clamp, a small displacement of the plies can be compensated while, during the sewing operation, the ply advanced at a lower speed contracts again, without forming wrinkles. Further, by means of the trailing clamp, if the pieces of material are cut inaccurately, to unequal lengths, the plies can be adjusted in length before starting the sewing operation or their lengths can be maintained during the sewing operation. The trailing edges may, in this case, be brought into registration, or mutually adjusted, so that either the shorter ply is manually stretched to the measure of the longer one or the longer ply is adjusted by upsetting or creasing to the shorter ply with, in the latter case, the stretching of the plies being produced by the trailing clamp. While, for stretching the shorter ply of material, a pull must be exerted thereon by the operator, in the second case, the operator has to exert a pull on the trailing clamp in order to displace it from the initial position thereof to the trailing edges of the two plies. Thus, the alignment and clamping of the plies in the trailing clamp requires, in any case, a more or less considerable exertion of force on the part of the operator and a certain amount of attention so that, particularly if pieces are involved having unequal lengths already prior to the sewing operation, the quality of the resulting work still depends on the reliability and skill of the operator, in spite of a partial mechanization of the operations.

SUMMARY OF THE INVENTION

The present invention is directed to automation of the mutual adjustment in length of plies of material which, in unsewn state, have unequal lengths, in order to provide permanently constant conditions, independent of outside influences, for an optimum working result.

To this end, the present invention is directed to a device which, in the course of a relative motion taking place between the device and the plies of material, engages the plies automatically at a permanently constant distance from their trailing edges and, in order to produce an adjustment to equal lengths exerts a pull on the trailing edges, depending on the respective differential length.

For this purpose, in accordance with the invention, an intermediate plate is provided separating the two plies of material and, at each side of the plate, a sensing mechanism is mounted which is operationally controllable by the respective ply of material for controllably engaging a clasp which is movable in the feed direction of the plies of material. The clasps are connected to each other through a structural part exerting a pull in a direction opposite to the feed direction of the plies of material.

During a relative motion between the material plies, on the one hand, and the mechanisms and clasps, on the other hand, during which either the material plies move in the sewing direction and/or the mechanisms and clasps move in the opposite direction, if the material plies are of unequal lengths, the trailing edge of the shorter material ply comes first into the sensing range of the respective associated sensing device constituted, for example, by a reflex light barrier, whereupon, the corresponding clasp is actuated and engages the respective ply of material. The structural part connecting the clasps to each other then exerts a pull on the shorter ply, which may be produced, for example, by gravity or by friction between the structural part and a backing. The pull leads to a stretching of the shorter ply and must be provided at least in a magnitude such that the shorter ply continues to be stretched at least until also the trailing edge of the initially longer ply of material comes into the sensing range of the sensing device associated therewith, whereupon this ply is engaged by the respective clasp. Then, both plies of material are adjusted to the same length.

In order to obtain a secure adjustment in length also under unfavorable conditions, the pull exerted by the structural part connecting the clasps to each other is advantageously chosen to have a magnitude such that the initially longer ply of material, after being engaged by the associated clasp, is first also stretched to a small extent and that, thereupon, only the tensile forces issuing from the material plies in stretched state become stronger than the oppositely directed pull exerted by the structural part and it is only from that instant that the clasps and the structural part are pulled along by the two plies of material. As soon as the two plies of material are stretched or elongated, a displacement of the material plies occurring during the sewing operation and due to unequal friction conditions can also be compensated by the inventive device.

The relative motion between the plies of material, on the one hand, and the mechanisms and clasps, on the other hand, is advantageously produced so that, after clamping the plies between the feed tools of the sewing machine and introducing them into the zone of action of the mechanisms and clasps, the sewing operation is started, whereupon the plies move relatively to the mechanisms and clasps which are at rest in their initial positions. In this manner, the detection of the trailing edges, the connection of the plies to the clasps and the mutual adjustment in length take place during the sewing operation, so that no additional time extending the total duration of a sewing cycle is required for the mentioned operational steps. Thus, since the operator has only to bring the plies of material in position and the subsequent operations take place automatically, working results are obtained which are uniform to the largest extent and, in practice, independent of any lack of attention or skill of the operator.

In accordance with a development of the invention, the intermediate plate extends in a substantially vertical plane and the clasps are secured to a support which is movable in a substantially vertical direction. Due to the vertical disposition of the intermediate plate, the plies of material can be placed in the range of action of the mechanisms and clasps in a freely suspended and, thereby, unobstructed position, so that this operation may be effected by means of an air blast acting on the plies of material, which again relieves the operator of working effort. As compared to a horizontal arrangement, the vertical orientation of the plies of material has the further advantage that, during a positioning of long plies, there is no need for the operator to shuttle between the clamping point of the sewing machine and the clasps, nor to contort his or her body.

Although the clasps are able to produce a certain pull on the plies already due to their own weight, the pull necessary for the complete adjustment in length is mainly produced by the support, so that the support performs the function of the above mentioned structural part intended for producing the pull. Besides, the vertical direction of motion of the clasps permits a direct connection to the mentioned structural part so that additional connecting elements, such as traction ropes and return pulleys, which would be needed with horizontally moved clasps, become superfluous.

In order to ensure a timely and rapid engagement of the plies by the clasps at a permanently constant distance from the trailing edges thereof even with ready-made pieces of unequal size, a motor-driven lifting carriage is provided below and within the range of motion of the support, which carriage is also movable vertically and comprises at least one mechanism for stopping the lifting carriage, operationally controllable by one of the plies of material. In this case, the mechanisms for engaging the clasps are movable, at least up to the instant of engagement, in synchronism with the clasps. For this purpose, these mechanisms may be secured to the support for the lifting carriage.

The lifting carriage elevates the clasping station, comprising the clasps and the support, as well as the mechanisms associated with the clasps, up to a level at which the shortest possible plies of material, for example, cut pieces of childrens' shorts, are just still engageable. Thereupon, the lifting carriage with the clasping station and the mentioned mechanisms resting thereon moves downwardly again until, by means of the mechanism serving to stop the lifting carriage, the trailing edge of one of the plies of material is detected and, in consequence, the lifting carriage is stopped. Since two plies of material to be sewn together fit each other in size and, therefore, differences in length are limited to a few centimeters, it is sufficient to sense only one of the two plies of material, as long as the vertical distance between the mechanism associated with the lifting carriage and the mechanisms associated with the clasps is sufficiently large. The up and down motion of the lifting carriage can be superposed in time to other operations within a sewing cycle so that the total time of a sewing cycle is not extended by the operation of the lifting carriage.

Since, in the presence of guide elements, for example, guide rollers, the clasping station could be too heavy for some kinds of material, a pulling means is provided, in accordance with a further development of the invention, and this is passed around return pulleys, is attached to the support, and is loadable by a counterbalance weight reducing the pull exerted on the plies of material by the clasping station. At the same time, the effective weight of the clasping station is reduced to an extent such that the highest pull admissible for thin and delicate materials is not exceeded. To be able to exert a pull which is sufficiently strong also for thicker and firmer materials, it is further provided to connect one of the return pulleys to a braking mechanism which is capable of transferring frictional or braking forces to the pulling means. These frictional or braking forces are transmitted to the clasping station, whereby the pull exerted on the plies is increased, more or less, depending on the adjustment of the braking mechanism. In addition, the braking mechanism is designed so as to perform still another function. That is, as soon as, toward the end of the sewing operation, the clasps are disengaged and, thereupon, the clasping station falls back from its lifted position, the clasping station is braked down, by means of the braking mechanism, before impinging upon the lifting carriage.

In a particularly advantageous embodiment of the clasps, each clasp comprises a plurality of retaining needles which are arranged one after the other in the feed direction of the plies of material, extend perpendicularly to the intermediate plate, and are adapted to project into a groove provided in the intermediate plate and extending parallel to the feed direction of the plies. Due to the particular arrangement of the retaining needles, the pull produced by the clasping station is transferred to the plies in the form of a plurality of smaller, individual, forces whereby the risk that the plies could tear up in the area of their trailing edges is eliminated. The grooves of the intermediate plate opposing the retaining needles ensure a secure engagement of the needles into the plies and, in addition, enable the stationary intermediate plate to cooperate with the respective clasp as a second half of a clamp, which makes it possible, because of a saving of such a second half of a clamp movable along with the support, to design the clasps in a particularly simple manner.

In accordance with a second, modified, embodiment of the invention, the support supporting the clasps, and also the mechanisms for engaging the clasps, are secured to a pulling means which is connected, through an engageable and disengageable clutch, to a drive mechanism. This second embodiment differs from the first one in a simpler design using a conventional clutch instead of a lifting carriage and an expensive braking mechanism.

An object of the invention is to automate the mutal adjustment in length of plies of material which, in the unsewn state, have unequal lengths.

Another object of the invention is to provide a device for effecting automation of such mutual adjustment in length of plies of material which, in the unsewn state, have unequal lengths.

A further object of the invention is to provide such a device which, in the course of a relative motion between the device and the plies of material, engages the plies automatically at a permanently constant distance from their trailing edges and exerts a pull on the trailing edges depending on the respective differential length.

For an understanding of the principles of the invention, reference is made to the following description of typical embodiments thereof as illustrated in the accompanying drawings.

BRIEF DESCRIPTION OF THE DRAWINGS

In the drawings:

FIG. 7 is a view, partly in section at a right angle to FIG. 6, of the second embodiment of the inventive device; and FIG. 8 is a sectional view of the inventive device taken along the line VIII—VIII of FIG. 7.

DESCRIPTION OF THE PREFERRED EMBODIMENTS

Figure 1:
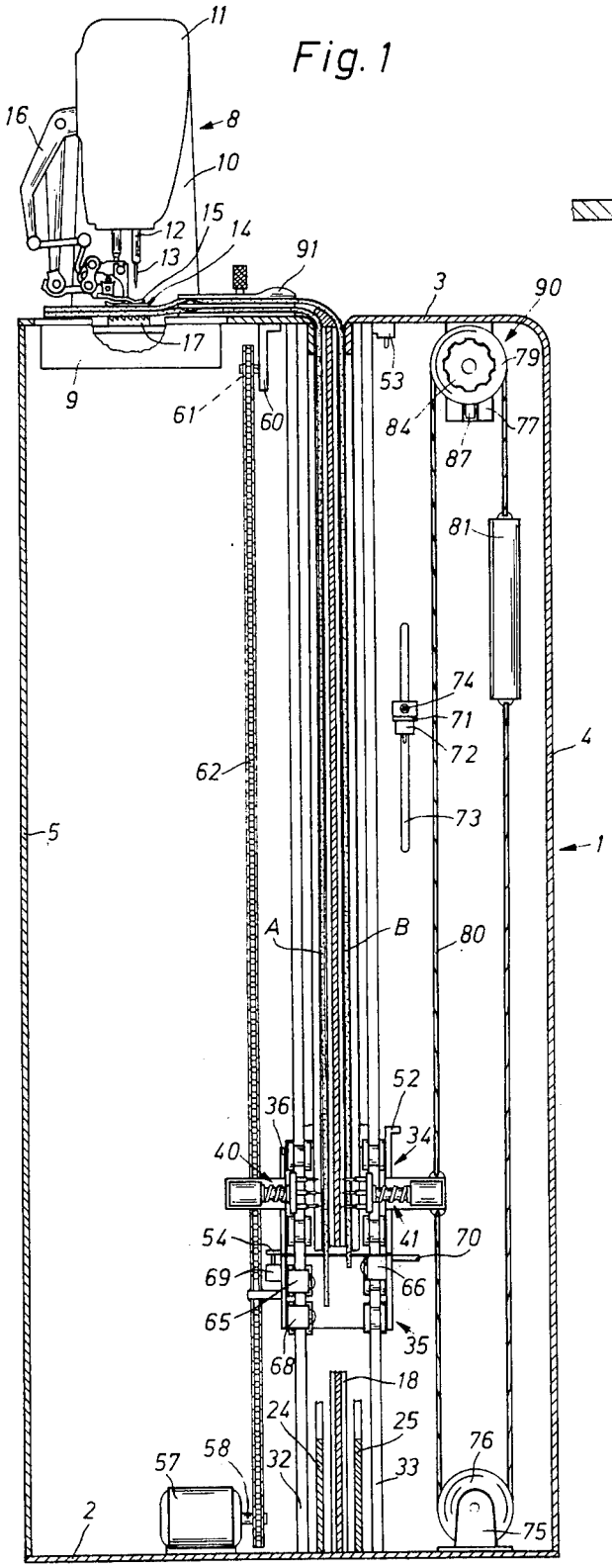
FIG. 1 is a sectional view of the sewing unit incorporating one embodiment of the inventive device.
Figure 4:
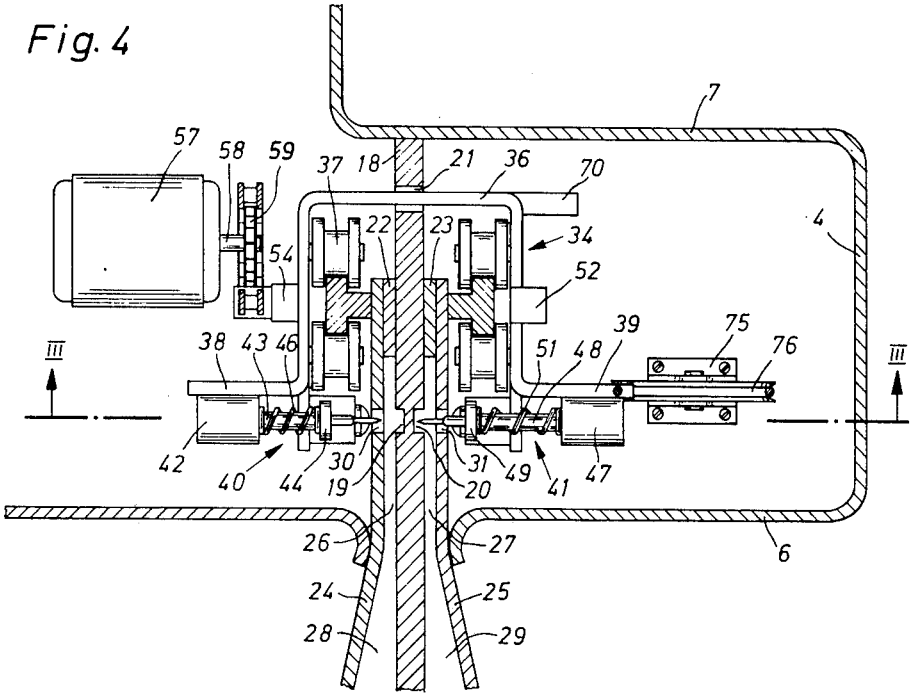
FIG. 4 is a sectional view of the part of the sewing unit comprising the clasping station and the lifting carriage, taken along the line IV—IV of FIG. 3.

The sewing unit comprises a casing 1 of which a bottom plate 2, a cover plate 3 and two side walls 4, 5 are shown in FIG. 1 and two further side walls 6 and 7 are shown in FIG. 4. Cover plate 3 supports a sewing machine 8 which is equipped for upper and lower feeds and of which the bed plate 9, the column 10 and the head 11 are indicated. Head 11 supports the needle bar 12 carrying the needle 13. Also shown are the presser foot 14, the top feed dog 15 and its drive mechanism 16, as well as the bottom feed dog 17.

In casing 1, an intermediate plate 18 is mounted extending in a vertical plane from bottom plate 2 up to cover plate 3 and projecting laterally from an opening of side wall 6. Intermediate plate 18 is formed with a vertically extending slot 21 (FIG. 4) and, on each of its larger plane surfaces, with a respective vertically extending groove 19, 20. On each plane surface of intermediate plate 18, a spacer plate 22, 23 is provided and a respective guide plate 24, 25 is applied against each spacer plate. Guide plates 24, 25 extend, within casing 1, parallel to intermediate plate 18 and from bottom plate 2 up to cover plate 3 and, in the same manner as intermediate plate 18, project laterally from the mentioned opening of side wall 6. The portions of guide plates 24, 25 which are located within casing 1 form, along with intermediate plate 18, two parallel guide slots 26, 27 extending across cover plate 3 and intended for receiving the plies of material A, B to be sewn together, while the portions of guide plates 24, 25 located outside casing 1 are angled away from each other, whereby inlet flares 28, 29 are formed. Each guide plate 24, 25 is provided with a respective slot 30, 31 located opposite the respective groove 19, 20 and also extending vertically.

In the first embodiment shown in FIGS. 1–5, guide rails 32, 33 are secured to guide plates 24, 25, and also extend from bottom plate 2 up to cover plate 3. Aside from the fixed plates, the device serving for adjusting plies of material to equal lengths and/or holding them in that position further comprises a clasping station 34 and a lifting carriage 35. Clasping station 34 includes a substantially U-shaped support 36 (FIG. 4) which, in the zone of intermediate plate 18, extends through slot 21 and which is vertically movable and secured against lateral tilting or torsion by means of eight guide rollers 37 running on guide rails 33, 32. Support 36 is provided with lugs 38, 39 which are angled outwardly and support respective clasps 40, 41. Clasp 40 comprises an electromagnet 42 with a pull rod or armature 43, a needle bar 44 secured to the end of pull rod 43 and carrying three needles 45, and a compression spring 46 surrounding pull rod 43. Clasp 41 is of identical design and, consequently, comprises an electromagnet 47 with a pull rod or armature 48, a needle bar 49, three needles 50 and a compression spring 51. As shown in FIG. 4, clasps 40, 41 are mounted so that, in working position, needles 45, 50 extend through slots 30, 31 into grooves 19, 20. Support 36 is further provided with a stop angle 52 cooperating with a limit switch 53 which is secured at the upper end of guide rail 33. A stop plate 54, cooperating with a limit switch mentioned hereinafter, is also carried by support 36.

Lifting carriage 35 comprises a frame 55 which has a shape similar to support 36 and which also extends, in the zone of intermediate plate 18, through slot 21 and is vertically movable and secured against lateral tilting or torsion by means of eight guide rollers 56 running on guide rails 32, 33. Lifting carriage 35 is driven by means of a chain drive comprising a motor 57 secured to bottom plate 2, a sprocket wheel 59 secured to the motor shaft 58, a sprocket wheel 61 mounted for free rotation on a support 60, and a chain 62. Chain 62 is firmly attached to frame 55 of lifting carriage 35. On frame 55, in front of slots 30, 31, two reflex light barriers 63, 64 are mounted, each comprising a light source and a photoconductive cell (not shown in detail). The base surface of each of grooves 19, 20 serves as the reflecting surface. Along with respective signal amplifiers (not shown), reflex light barriers 63, 64 form two sensing devices 65, 66 for controlled engagement of clasps 40, 41, which are operationally controllable by the plies of material A, B to be sewn together.

As may be seen in FIG. 1, in the zone of cover plate 3, ply B advances along a path having a greater radius of deflection than ply A, wherefore ply B has to cover a longer distance to the stitch forming area of sewing machine 8, given by the difference between the two deflection radii. Taking this fact into account, reflex light barrier 64 is mounted higher than reflex light barrier 63, by a distance corresponding to the mentioned difference between the radii of deflection. Beneath reflex light barrier 63, facing slot 30, a further reflex light barrier 67 is mounted on frame 55 which, along with a corresponding signal amplifier (not shown), forms a sensing device 68 for controlled stopping of lifting carriage 35, and which is operationally controllable by ply A. Frame 55 further carries a limit switch 69 cooperating with stop plate 54. A stop plate 70, provided on frame 55, cooperates with a limit switch 72 which is mounted on an angle plate 71. Angle plate 71 is displaceable along a slot 73 provided in side wall 7 and can be fixed by means of a screw 74 which is actuable from outside casing 1.

Figure 5:
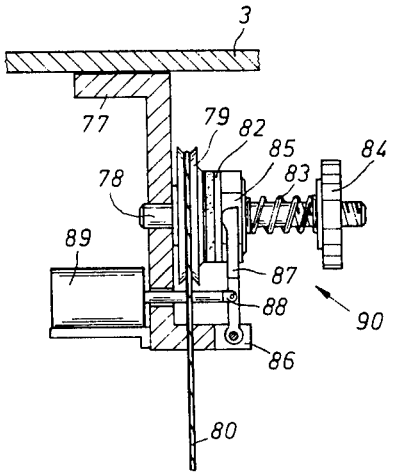
FIG. 5 is an elevation view of the braking mechanism, partly in section.
Figure 2:
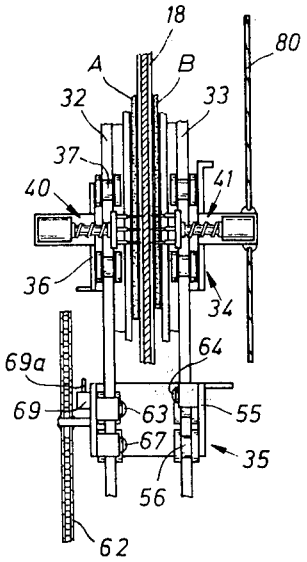
FIG. 2 is a detail of FIG. 1 in which the position of the clasping station and the lifting carriage is shown in a later phase of the sewing cycle.
Figure 3:
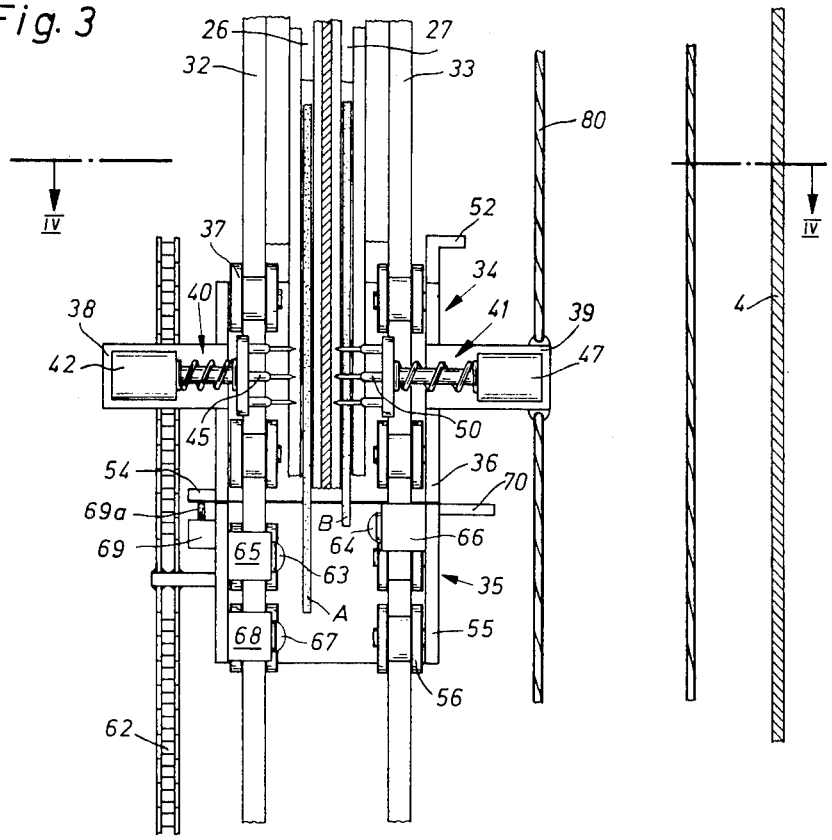
FIG. 3 is a sectional view of the part of the sewing unit comprising the clasping station and the lifting carriage, taken along the line III—III of FIG. 4.

A bearing bracket 75 supporting a freely rotatable pulley 76 is secured to bottom plate 2. To the underside of cover plate 3, a support 77 is secured with a partly threaded bolt 78 non-rotatably mounted thereon. A pulley 79 is mounted for free rotation on bolt 78. A rope 80, attached to support 36 and carrying a counterbalance weight 81, is passed around pulleys 76, 79. There are also mounted on bolt 78, as shown in FIG. 5, a brake disc 82, a compression spring 83 and, on the threaded portion of the bolt, a hand wheel 84 also provided with a thread. Brake disc 82 comprises two flats 85 which are provided at mutually opposite locations of the disc. A brake lever 87, pivoted in a slot 86 of support 77 and having a forked end, is engaged, by the fork, over the two flats 85 thereby preventing brake disc 82 from rotating. Brake lever 87 is hinged to a pull rod or armature 88 of an electromagnet 89 which is secured to support 77. Component parts 82 through 89 constitute a braking mechanism, generally designated 90. Before the stitch forming area of sewing machine 8, a well-known guide mechanism 91 is provided on cover plate 3, serving for an automatic congruent alignment of the side contours of plies A, B.

Figure 6:
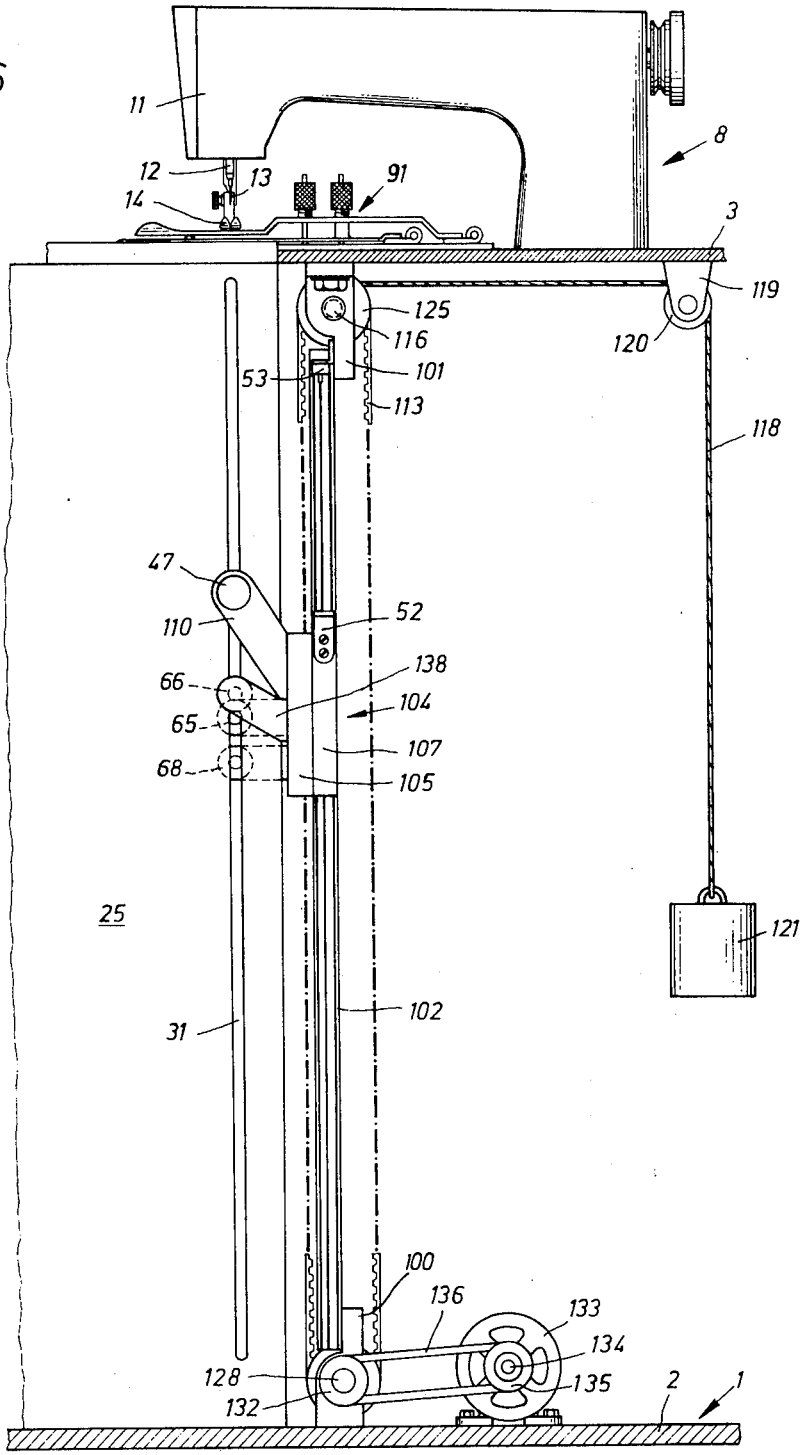
FIG. 6 is an elevation view of a sewing unit, partly in section, showing a second embodiment of the inventive device.

The second embodiment of the inventive device, shown in FIGS. 6, 7 and 8, also comprises an intermediate plate 18 and two guide plates 24, 25 which, in connection with two spacer plates 22, 23, form two guide gaps 26, 27 for the plies of material C, D. A bearing block 100 is supported on bottom plate 2 and a bearing support 101 is secured to the underside of cover plate 3. Instead of guide rails 32, 33 used in the first embodiment, in this case, there is provided a guide bar 102 extending vertically between block 100 and support 101 and provided with guide grooves 103. A clasp carriage 104 is mounted on guide bar 102 and comprises a support 105 and two ball retainers 106, 107 with a plurality of balls 108. Balls 108 run in guide grooves 103 whereby clasp carriage 104 is vertically movable and secured against lateral tilting or torsion.

By means of two clamping strips 111, 112, support 105 is secured to the ends of a gear belt 113 which is run over two gears 114, 115. Gear 114 is mounted for free rotation on a shaft 116 which is secured to bearing support 101. Also mounted on shaft 116 is a pulley 117 which is non-rotatably connected to gear 114. A rope 118 is attached to pulley 117, trained around a corner pulley 120 which is mounted on a supporting bracket 119, and loaded, at its other end, with a counterbalance weight 121. Counterbalance weight 121 reduces the effective weight of clasp carriage 104 to approximately 300 g.

Shaft 116 also supports a braking mechanism 122 comprising an axially shiftable brake disc 123, a compression spring 124, and a hand wheel 125 which is provided with a thread and is screwed on a threaded portion of shaft 116. Brake disc 123 carries a pin 126 which engages into a slot 127 provided in shaft 116 and thereby prevents brake disc 123 from rotating.

Gear 115 is mounted for free rotation on a shaft 128 which, in turn, is mounted on bearing block 100. Shaft 128 carries an electromagnetically actuable clutch 129 of which one part 130 is mounted for free rotation on shaft 128 but, at the same time, non-rotatably connected to gear 115. The other part 131 of the clutch is secured to shaft 128 and firmly connected to a pulley 132. The drive mechanism comprises a conventional brake motor 133, a pulley 135 secured to the motor shaft 134 and a drive belt 136 passed around pulleys 132 and 135.

Two mounting brackets 109, 110 are provided on support 105, each carrying a respective clasp 40, 41. Clasps 40, 41 are identical with the corresponding clasps 40, 41 of the first embodiment, so that their description need not be repeated. Support 105 is further provided with a stop angle 52 cooperating with a limit switch 53 which is secured to bearing support 101.

Two angle pieces 137, 138 are secured to support 105, each carrying a respective reflex light barrier 63, 64 facing a respective slot 30, 31. Reflex light barriers 63, 64 comprise a light source and a photoconductive cell (not shown) and the base surface of each of the grooves 19, 20 serve as the reflecting surface. Along with corresponding signal amplifiers (not shown), reflex light barriers 63, 64 form respective devices 65, 66 for a controlled engagement of respective clasps 40, 41, which are operationally controllable by the plies of material C, D to be sewn together. Since the top outlet of guide gap 26, receiving ply C, is located nearer to the stitch forming area of sewing machine 8 than is the top outlet of guide gap 27, receiving ply D, ply D must cover a longer distance to the stitch forming area than ply C. For taking into account this difference, reflex light barrier 64 is mounted at a correspondingly higher location relative to reflex light barrier 63. A further reflex light barrier 67 facing slot 30 is mounted below reflex light barrier 63 on an angle piece 139 which is secured to support 105 and this barrier 67, along with a corresponding singal amplifier (not shown), forms a device 68 for controlled stopping of clasp carriage 104, which is operationally controllable by the ply C.

Before the stitch forming area of sewing machine 8, another well known guide mechanism 91 is provided on cover plate 3, and serves for an automatic, congruent, alignment of the side contours of plies C and D.

The device in accordance with the invention operates as follows:

The plies of material A, B shown in FIG. 1, are cut pieces of mens' or boys' trousers having side pockets. The side seams are sewn from the waistband to the hem and, during each sewing cycle, first, the approximately 10 to 15 cm long seam portion located in the pocket zone is formed.

At the beginning of a sewing cycle, comprising the operations of positioning the material, sewing, and removing the material, with needles 45, 50 retracted, the plies of material A, B are introduced into guide gaps 26, 27 and are brought into contact with spacer plates 22, 23. Then, with guide mechanism 91 swung back, the leading edges of plies A, B, lying in the waistband zone, after being brought into registry with each other, are tightly clamped between presser foot 14 and the needle plate of sewing machine 8 (not shown). Following this, sewing machine 8 is put into operation and, thereby, the sewing operation is started. Since, during the sewing in the pocket zone, plies A, B must be guided with particular care to obtain a flawless working result, this portion of the seam is formed with the guide mechanism 91 still swung back and at a relatively low speed, while feeding the material into the sewing machine manually.

During the above-described operations of positioning the material and sewing in the pocket zone, lifting carriage 35 brings clasping station 34 into an initial position corresponding to the respective length of the pair of plies. For this purpose, simultaneously with the positioning of plies A, B, motor 57 is started so as to move, through chain 62, the lifting carriage 35 and the clasping station supported thereon upwardly. As soon as stop plate 70 of lifting carriage 35 actuates limit switch 72, the direction of rotation of motor 57 is reversed whereupon lifting carriage 35 along with clasping station 34 supported thereon is moved downwardly again. During this motion, the beam emitted by reflex light barrier 67 senses the ply of material A. Depending on whether the treated pieces are parts of boys' or mens' trousers, or are of large or small size, the trailing edge of ply A will run out of the beam of reflex light barrier 67 sooner or later and then the light beam will be reflected by the base surface of groove 19. In response thereto, motor 57 is stopped and lifting carriage 35 along with clasping station 34 remains in this position.

The stopping of lifting carriage 35 takes place approximately at the same time at which the sewing in the pocket zone is terminated. With the seam portion located in the pocket zone completed, sewing machine 8 is stopped, guide mechanism 91 is swung forwardly into its working position and then sewing machine 8 is started again, however, now at a higher speed, in order to sew the remaining, larger, portion of the seam more rapidly. During this phase, top feed dog 15 and bottom feed dog 17 produce a relative motion between the two plies A, B on the one hand, and the stopped reflex light barriers 63, 64, on the other hand. As soon as the trailing edge of the shorter ply B runs out of the light beam of reflex light barrier 64, the beam is reflected by the base surface of groove 20, whereupon device 66 actuates clasp 41 by de-energizing electromagnet 47. Compression spring 51, thereby released, pushes needles 50 through ply B, which is backed by intermediate plate 18, into groove 20 whereby the trailing end of ply B becomes firmly attached to clasping station 34. In the course of further feed of plies A, B, clasping station 34 which, as before, is supported on lifting carriage 35, holds the trailing end of ply B back, which results in a stretching of ply B. At the instant at which the initially shorter ply B is stretched to exactly the length of the initially longer ply A, the trailing edge of the hitherto still freely suspended ply A also runs out of the light beam of its associated reflex light barrier 63 whereby clasp 40 is also actuated and needles 45 are pushed through ply A into groove 19.

To securely obtain an exact adjustment in length of the initially unequally long plies of material A, B, it must be ensured that the pull in the upward direction, which is exerted on clasping station 34 by ply B and constantly increases during the stretching operation, is adjusted so that only after ply A is also engaged by the clasp, the upward pull becomes stronger than the downwardly directed pull exerted on ply B by the clasping station, which could also be designated as a braking or retaining force. The pull produced by clasping station 34 depends on the difference between the weight of clasping station 34 and the weight of the counterbalance 81 as well as on the braking force exerted by braking mechanism 90 on rope 80. The total pull exerted by clasping station 34 can be varied by turning hand wheel 84 which produces a variation of the contact pressure of brake disc 82. It would also be possible, in extreme cases, to replace counterbalance weight 81 by another weight. In order to enable the operator to actuate hand wheel 84 rapidly and without particular complications, it is advantageous to provide a sufficiently large opening in side wall 6 of casing 1, which modification is not shown in the drawings.

After ply A is also engaged by its associated clasp and, thereby, firmly connected to clasping station 34, in addition to the stretching of ply B, ply A is also stretched to a small extent until the pulls presently exerted on clasping station 34 by both of the plies A and B exceed the braking or retaining force exerted by the clasping station. As from this instant, the two plies A and B pull the clasping station along and, during this upwardly directed motion, clasping station 34 retains the two plies A, B in their previously established longitudinally correctly aligned position, thereby ensuring that the plies A, B are sewn together in longitudinal registration with each other. The upwardly directed motion of clasping station 34 is stopped as soon as limit switch 53 is actuated by stop angle 52 since, then, electromagnets 42 and 47 are energized, needles 45 and 50 are retracted from grooves 19, 20 and guide gaps 26, 27 and, consequently, plies A and B become disengaged from the clasps. While the now still remaining portion of the seam to be produced is sewn to the end, clasping station 34 moves downwardly again, automatically. As soon as stop plate 54 actuates limit switch 69, whose switching element 69a, in unloaded state, projects beyond the upper edge of frame 55, electromagnet 89 is energized for a short time whereby brake disc 82, through pull rod 88 and brake lever 87, is pressed against pulley 79 so strongly that the downward movement of clasping station 34 is decelerated just shortly prior to touching down on lifting carriage 35. In this manner, a hard impact of clasping station 34 on lifting carriage 35 is prevented.

In the second embodiment of the invention, the plies of material C, D (FIG. 7) are assumed to be cut pieces of women's or girls' slacks having no side pockets.

At the beginning of a sewing cycle, the two plies of material C, D are positioned in the sewing unit or introduced into gaps 26, 27 in the manner as in the example of the first embodiment and are also clamped, with their leading edges in registry with each other, between the presser foot 14 and the needle plate (not shown) of sewing machine 8. Since slacks have no side pockets, there is no need for a manual sewing in the pocket zone as with men's trousers. In consequence, immediately after the clamping of the leading edges of plies C, D, guide mechanism 91 can be swung into its working position. Thereupon, sewing machine 8 is started to produce the side seam, first, at a reduced sewing speed.

During the introduction of plies C, D into guide gaps 26, 27, the brake of brake motor 133 is released and the motor is started. Since, at that time, electromagnetically actuable clutch 129 is engaged, gear belt 113 is driven counterclockwise, as viewed in FIG. 6, the clasp carriage 104 is moved downwardly from its upper standstill position. During this motion, the beam emitted by reflex light barrier 67 senses the ply of material C. Depending on whether the treated piece is a part of women's or girls' slacks, or of large or small size, the trailing edge of ply C will run out of the beam of reflex light barrier 67 sooner or later, whereupon the light beam is reflected by the base surface of groove 19. In consequence, brake motor 133 is switched off whereby clasp carriage 104 is stopped in this position which is an initial position for the subsequent engagement of clasps 40, 41.

As soon as clasp carriage 104 has reached the mentioned initial position, the sewing operation is continued at a higher speed. The adjusted vertical distance between reflex light barriers 63, 64, on the one hand, and reflex light barrier 67, on the other hand, is so small that the trailing edge of the shorter ply D runs out of the beam of reflex light barrier 64 only a short time after the stopping of clasp carriage 104, whereupon the light beam is reflected by the base surface of groove 20. In response thereto, device 66 actuates clasp 41 by de-energizing electromagnet 47. Due to the following release of compression spring 51, needles 50 are pushed, through ply D backed by intermediate plate 18, into groove 20 whereby the trailing end of ply D becomes firmly connected to clasp carriage 104. Simultaneously with engagement of clasp 41, electromagnetically actuable clutch 129 is disengaged so that, from this instant and for the duration of the following sewing operation, clasp carriage 104 is no longer connected to brake motor 133. Due to the disengagement of clutch 129, clasped ply D becomes loaded with the effective weight of clasp carriage 104 and, depending on the resistance of the material, is more or less stretched, whereby the distance between the trailing edge of clasped shorter ply D and the trailing edge of the not yet clasped longer ply C is reduced. In the course of the continuing sewing operation, the not yet clasped ply C is advanced somewhat faster than ply D by which clasp carriage 104 is pulled along because, due to the pull produced by clasp carriage 104 and opposed to the direction of advance, a slip occurs at each individual feed step produced by the feed tools. Thus, the trailing edge of ply C gradually draws closer to reflex light barrier 63 which is moved in the upward direction more slowly, at the advance speed of ply D. At the moment at which the initially shorter ply D is exactly as long as the initially longer ply C, the trailing edge of ply C runs out of the beam of reflex light barrier 63, whereupon clasp 40 is also actuated and needles 45 are pushed through ply C into groove 19. Since the initially longer ply C is also clasped to clasp carriage 104, during the subsequent, remaining, sewing operation, clasp carriage 104 holds the two plies C, D in a position of mutually equal length which results in a longitudinally correctly aligned sewing together of plies C and D.

The upward movement of clasp carriage 104 is terminated as soon as stop angle 52 actuates limit switch 53 whereby electromagnets 42, 47 are energized, needles 45, 50 are retracted from grooves 19, 20 and guide gaps 26, 27 and, consequently, plies of material C and D are released. Simultaneously with the disengagement of clasps 40, 41, clutch 129 is engaged whereby clasp carriage 104 is coupled to the switched-off brake motor 133. In this manner, clasp carriage 104 is arrested in its upper position wherefrom it is moved downwardly only after a new positioning to two further plies of material and switching on of brake motor 133.

Due to counterbalance weight 121, the effective weight of clasp carriage 104 is reduced to an extent such that the strongest pull admissible for thin and delicate materials is not exceeded. In order to be able to exert a sufficiently strong pull on the respective shorter ply of thicker and more resistant materials, brake disc 123 can be pressed against gear 114 by turning hand wheel 125. Thereby, a braking force is produced impeding the motion of clasp carriage 104 so that a stronger pull is exerted on the clasped shorter ply of material.

Only a very short period of time elapses between the detection of the trailing edges of the plies of material by reflex light barriers 63 or 64 and the engagement of clasps 40, 41. This ensures that, with small differences in length, even an only slightly longer ply is properly clasped. That is, with a difference in length which is smaller than the distance through which clasp carriage 104, after the clasping of the shorter ply and the disengagement of clutch 129, is lowered relative to the non-clasped ply, a risk would be run, due to the slow reaction velocity of devices 65, 66 and clasps 40, 41, that only a part of needles 45 or 50 would engage the ply while the other part would be pushed into empty space, beneath and past the trailing edge of the ply.

The device disclosed as the second embodiment of the invention is particularly suited for the manufacture of girls' or women's slacks since clasp 104 reaches the initial position for the engagement of clasps 40, 41 sooner than clasping station 34 of the first embodiment. Consequently, a higher sewing speed can be used from an earlier point of time, which shortens the sewing cycle.

With the exception of the operations of positioning the plies of material, clamping beneath the presser foot 14, as well as, with boys' or men's trousers, manually guiding the material during formation of the seam in the pocket zone, all of the following operations, namely, the adjustment to equal length of the unequally long plies of material, the congruent alignment of the lateral edges, and the sewing together of the registering plies, take place automatically. Since the last-mentioned operations represent the majority of the entire sewing cycle and the adjustment to equal lengths requires an exactly dimensioned pull on the shorter of the two plies of material, which remains constant for the duration of the sewing operation, the operator is quite considerably relieved of physical effort by the automation of these operations. As a further, very substantial advantage due to the automation of the mentioned operations, a constantly flawless output is obtained, since a possible lack of attention or skill of the operator has no influence whatsoever on the result.

While specific embodiments of the invention have been shown and described in detail to illustrate the application of the principles of the invention, it will be understood that the invention may be embodied otherwise without departing from such principles.

What is claimed is:

1. In a sewing unit including a sewing machine, a device for automatically adjusting two plies of material, which are to be sewn together by the sewing machine and which register with each other at their leading edges, to mutually equal lengths and to maintain their trailing edges in fixed relation to each other during the sewing operation, said device comprising, in combination, a relatively elongated intermediate plate separating the two plies in advance of the sewing machine; respective clasps, adjacent opposite surfaces of said intermediate plate, selectively engageable with the adjacent ply of material; means mounting said clasps for movement in the feed direction of the plies by engagement with the respective adjacent plies; respective sensing means operatively associated with each ply of material and each operable to sense the trailing edge of the associated ply; means operable, responsive to sensing of the trailing edge of an associated ply by the respective sensing means, to effect engagement of the respective clasp with the associated ply of material for movement therewith; a structural part interconnecting said clasps; and means, including said structural part, operable to exert a pull on the plies of material in a direction opposite to the feed direction of the plies of material.

2. A device, as claimed in claim 1, in which said intermediate plate is vertically oriented and said structural part comprises a vertically movable support.

3. A device, as claimed in claim 2, including vertically oriented guide means engaged with said support and guiding said support during its vertical movement.

4. A device, as claimed in claim 3, comprising a lifting carriage engaged with said guide means below said support and within the range of motion of said support; a motor operable to move said lifting carriage vertically of said guide means; a third sensing means operatively associated with one ply of material to sense the trailing edge thereof to controllably stop said lifting carriage; said first-named sensing devices, for effecting engaging of said clasps being movable, at least up to the instant of engagement of said clasps with the plies of material, in synchronism with said clasps.

5. A device, as claimed in claim 4, in which said sensing means are mounted on said lifting carriage.

6. A device, as claimed in claim 2, including a pull means operatively connected to said support; and a counterweight connected to said pull means and at least partially balancing the weight of said support.

7. A device, as claimed in claim 6, in which said pull means is trained over at least one pulley; and an adjustable braking mechanism connected to one of said pulleys.

8. A device, as claimed in claim 6, in which said pull means comprises an endless gear belt connected to said support and trained over gears; a drive mechanism; and a clutch selectively operable to connect said drive mechanism to one of said gears.

9. A device, as claimed in claim 1, in which said intermediate plate is formed with respective elongated grooves in each of its opposite planar surfaces extending longitudinally throughout the length of said intermediate plate; each clasp comprising a plurality of retaining needles aligned successively in the feed direction of the plies of material; said engagement effecting means being operable to project said retaining needles perpendicularly to said intermediate plate through the adjacent ply of material and into the adjacent groove.

10. A device, as claimed in claim 1, in which said sewing machine is mounted on a horizontal plate; said intermediate plate being vertically oriented and being aligned with a transverse slot in said horizontal plate; the plies of material extending through said slot and over said horizontal plate to said sewing machine whereby one ply has to travel a greater distance than the other ply; said structural member being movable vertically of said intermediate plate; the sensing means associated with said one ply being positioned, on said structural member, at a distance above the sensing means associated with said other ply equal to the increased travel distance of said one ply.

* * * * *

UNITED STATES PATENT OFFICE

CERTIFICATE OF CORRECTION

Patent No. 4,036,156 Dated July 19, 1977

Inventor(s) Dietmar Becker et al.

It is certified that error appears in the above-identified patent and that said Letters Patent are hereby corrected as shown below:

On the cover sheet, in item [73] "Dec. 12, 1974" should read -- Dec. 5, 1974 --.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*

UNITED STATES PATENT OFFICE
CERTIFICATE OF CORRECTION

Patent No. 4,036,156 Dated July 19, 1977

Inventor(s) Dietmar Becker et al.

It is certified that error appears in the above-identified patent and that said Letters Patent are hereby corrected as shown below:

On the cover sheet, in item [30] "Dec. 12, 1974" should read -- Dec. 5, 1974 --.

This certificate supersedes Certificate of Correction issued January 3, 1978.

Signed and Sealed this

Ninth Day of May 1978

[SEAL]

Attest:

RUTH C. MASON
Attesting Officer

LUTRELLE F. PARKER
Acting Commissioner of Patents and Trademarks